US010584408B2

(12) United States Patent
Nakao et al.

(10) Patent No.: US 10,584,408 B2
(45) Date of Patent: Mar. 10, 2020

(54) CARBURIZATION DEVICE AND CARBURIZATION METHOD

(71) Applicants: NATIONAL UNIVERSITY CORPORATION YOKOHAMA NATIONAL UNIVERSITY, Yokohama-shi, Kanagawa (JP); NHK SPRING CO., LTD., Yokohama-shi, Kanagawa (JP)

(72) Inventors: Wataru Nakao, Yokohama (JP); Akira Tange, Yokohama (JP); Koichi Tango, Koka (JP); Morimichi Kai, Yokohama (JP)

(73) Assignees: NATIONAL UNIVERSITY CORPORATION YOKOHAMA NATIONAL UNIVERSITY, Kanagawa (JP); NHK SPRING CO., LTD, Kanagawa (JP)

( * ) Notice: Subject to any disclaimer, the term of this patent is extended or adjusted under 35 U.S.C. 154(b) by 180 days.

(21) Appl. No.: 15/814,892

(22) Filed: Nov. 16, 2017

(65) Prior Publication Data

US 2018/0080113 A1 Mar. 22, 2018

Related U.S. Application Data

(63) Continuation of application No. PCT/JP2016/064183, filed on May 12, 2016.

(30) Foreign Application Priority Data

May 19, 2015 (JP) ..... 2015-101781

(51) Int. Cl.
*C23C 8/22* (2006.01)
*C21D 1/06* (2006.01)
(Continued)

(52) U.S. Cl.
CPC ..... *C23C 8/22* (2013.01); *C21D 1/06* (2013.01); *C21D 9/02* (2013.01); *C23C 8/20* (2013.01);
(Continued)

(58) Field of Classification Search
CPC .... C23C 8/22; C23C 8/80; C21D 1/06; F27B 9/3005
See application file for complete search history.

(56) References Cited

U.S. PATENT DOCUMENTS 3,968,957 A 7/1976 Asai et al.
4,059,122 A 11/1977 Kinoshita
(Continued)

FOREIGN PATENT DOCUMENTS

CN 101187002 A 5/2008
CN 101338358 A 1/2009
(Continued)

OTHER PUBLICATIONS

Chinese Office Action (and English language translation thereof) dated Mar. 14, 2019 issued in counterpart Chinese Application No. 201680027822.6.
(Continued)

*Primary Examiner* — Jessee R Roe
(74) *Attorney, Agent, or Firm* — Holtz, Holtz & Volek PC

(57) ABSTRACT

A carburization device includes a heating furnace which heats a material, a transfer mechanism, an alcohol vapor generator, an alcohol vapor spraying portion, a quenching tank, and an exhaust heat intake tube. The transfer mechanism moves a plurality of materials. The alcohol vapor generator uses part of heat generated by the heating furnace as a heat source. As the alcohol vapor spraying portion repeats a vapor spraying step and a diffusion step a plurality of times in the heating furnace. In the vapor spraying step,
(Continued)

by spraying alcohol vapor on the material which moves inside the heating furnace, carbon in the alcohol is adsorbed to the material. In the diffusion step, an interval for diffusing the carbon adsorbed to the material is taken.

11 Claims, 10 Drawing Sheets

(51) Int. Cl.

| | |
|---|---|
| ***C21D 9/02*** | (2006.01) |
| ***C23C 8/20*** | (2006.01) |
| ***F27B 9/40*** | (2006.01) |
| ***F27B 9/30*** | (2006.01) |
| ***F27D 17/00*** | (2006.01) |
| ***F27B 9/04*** | (2006.01) |
| ***C23C 8/80*** | (2006.01) |

(52) U.S. Cl.
CPC ..... *C23C 8/80* (2013.01); *F27B 9/045* (2013.01); *F27B 9/3005* (2013.01); *F27B 9/40* (2013.01); *F27D 17/004* (2013.01)

(56) References Cited

U.S. PATENT DOCUMENTS

| | | | | |
|---|---|---|---|---|
| 5,382,306 | A * | 1/1995 | Plata | B05B 7/0861 148/511 |
| 6,165,275 | A | 12/2000 | Kamei | |
| 8,828,150 | B2 | 9/2014 | Foerster et al. | |
| 2011/0277887 | A1 | 11/2011 | Foerster et al. | |
| 2015/0252863 | A1 | 9/2015 | Ono et al. | |

FOREIGN PATENT DOCUMENTS

| | | | |
|---|---|---|---|
| CN | 101809184 | A | 8/2010 |
| JP | 49105736 | A | 10/1974 |
| JP | 59015964 | B2 | 4/1984 |
| JP | 11092823 | A | 4/1999 |
| JP | 2007248042 | A | 9/2007 |
| JP | 2011026651 | A | 2/2011 |
| JP | 1923258 | B2 | 4/2012 |
| WO | 2014042066 | A1 | 3/2014 |

OTHER PUBLICATIONS

"Practical Heat Treatment Manual", Second Edition, Shanghai Science and Technology Press, Apr. 30, 2014, pp. 250-261.

Extended European Search Report (EESR) dated Oct. 5, 2018 issued in counterpart European Application No. 16796396.6.

Chinese Office Action (and English language translation thereof) dated Jul. 20, 2018 issued in counterpart Chinese Application No. 201680027822.6.

International Search Report (ISR) and Written Opinion dated Jul. 12, 2016 issued in International Application No. PCT/JP2016/064183.

* cited by examiner

CARBURIZATION DEVICE AND CARBURIZATION METHOD

CROSS-REFERENCE TO RELATED APPLICATIONS

This application is a Continuation Application of PCT Application No. PCT/JP2016/064183, filed May 12, 2016 and based upon and claiming the benefit of priority from prior Japanese Patent Application No. 2015-101781, filed May 19, 2015, the entire contents of all of which are incorporated herein by reference.

BACKGROUND OF THE INVENTION

1. Field of the Invention

The present invention relates to a carburization device and a carburization method for carburizing a steel product such as a spring member and various machine elements.

2. Description of the Related Art

In order to achieve the weight reduction of a vehicle such as a car and to improve fuel efficiency, reducing the weight of components which constitute the vehicle has been desired. Among the components which constitute the vehicle, a suspension spring is relatively heavy in weight as a unit, and is also an important component which supports the weight of the vehicle. Accordingly, the suspension spring is required to achieve the weight reduction while ensuring high reliability.

A suspension spring manufactured by hot working is heated in the atmosphere by a temperature-raising furnace in order to perform a hot coiling process. Accordingly, occurrence of decarburization (ferrite decarburization or partial decarburization) near a surface of the spring to some extent is unavoidable. When the spring is decarburized, the quenching hardness or the hardness after tempering is lowered, which becomes a factor of reducing the yield stress, and furthermore, reducing the fatigue strength. As the means for increasing durability of the spring, shot peening is effective. However, with the shot peening, it is not possible to produce compressive stress greater than the yield stress of a material to be treated (for example, a suspension spring). For this reason, reduction of the yield stress by the decarburization can be a cause of reduction of the effect of the shot peening.

As one of the means for resolving the problem of decarburization of steel products such as a suspension spring, a carburization treatment is effective. As conventional carburizing methods, a solid carburizing method, a liquid carburizing method, a conversion furnace gas carburizing method, an injection-type gas carburizing method, a vacuum carburizing method, a plasma carburizing method, and the like, are known. The conversion furnace gas carburizing method, the vacuum carburizing method, and the plasma carburizing method are disclosed in, for example, JPS59-15964 B (Patent Literature 1). Many studies have been made on these carburizing methods in the past, and a control method has also been established. Accordingly, these carburizing methods are applied to various industrial products including the spring member and a gear wheel.

However, these existing carburizing methods require a gas conversion furnace or a dedicated carburizing furnace. For this reason, not only is there a case where additionally installing such furnaces in the existing facilities where a spring manufacturing process is performed is difficult, but a large expense is also necessary. Moreover, normally, the carburizing method currently used industrially performs the carburization treatment while maintaining carburizing atmosphere gas around the material to be treated. Consequently, the carburization treatment performed in the above is of a batch type. Under the circumstances, a carburization treatment cannot be performed for a steel product manufactured by hot working which is continuously processed in a heat treatment furnace. Accordingly, the carburization treatment is desired to be performed by using a heating furnace (a heat treatment furnace) which heats the material under atmospheric conditions of an open system.

JP 2011-26651 A (Patent Literature 2) discloses a technology of performing the carburization treatment under atmospheric conditions of an open system. The carburization method and the carburization device of Patent Literature 2 comprise an annular heating coil which heats a material to be treated (a workpiece), and a gas nozzle which injects carburizing gas toward the heated material to be treated. An internal passage for circulating the carburizing gas is formed in the heating coil of Patent Literature 2. By using heat of this heating coil, the carburizing gas is heated. JP 4923258 B (Patent Literature 3) discloses a superheated steam generator which uses a capillary feedwater function of a porous body.

Since the heat treatment furnace (heating furnace) used in the spring manufacturing process or the like heats the material under the atmospheric conditions of an open system, the heat treatment furnace (heating furnace) is not hermetically closed. For this reason, with the existing carburization technology, it is difficult to perform the carburization treatment by using the heat treatment furnace of an open system if the material is one which moves in a continuous manufacturing line of steel products. Patent Literature 2 relates to the technology of performing the carburization treatment under the atmospheric conditions of the open system. However, in Patent Literature 2, the material to be treated (the workpiece) and the carburizing gas are heated by using a dedicated heating coil for the carburization treatment. Accordingly, the process performed in Patent Literature 2 is a baton process which is separated from a manufacturing process of the steel product. In other words, Patent Literature 2 requires equipment (heating coil, etc.) dedicated to the carburization treatment, and furthermore requires electric power for heating. In addition, since explosive carburizing gas such as propane is used, extreme caution must be taken when handling the gas.

BRIEF SUMMARY OF THE INVENTION

Accordingly, an object of the present invention is to provide a carburization device and a carburization method capable of performing the carburization treatment, which is carried out in a manufacturing process of a steel product such as a spring member, safely and efficiently with less items of equipment.

A carburization device according to one embodiment comprises a heating furnace which heats a material made of steel to a temperature at which quenching can be performed, a transfer mechanism such as a walking beam or a conveyor, an organic compound vapor generator, an organic compound vapor spraying portion, and quenching means for use in quenching the material which has been carburized. An example of the organic compound used for carburization is ethyl alcohol (ethanol). An example of the heating furnace heats the material to 980 to 1000° C. (i.e., an austenitizing temperature). The transfer mechanism moves a plurality of materials continuously or intermittently from an inlet portion to an outlet portion of the heating furnace.

The organic compound vapor generator produces organic compound vapor by evaporating a liquid organic compound by a heat source. The organic compound vapor spraying portion sprays the organic compound vapor on the material which moves within the heating furnace and causes carbon in the organic compound to be adsorbed to the material, and sprays the organic compound vapor on the material again after an interval of time for diffusion of the carbon. As described above, a carburization treatment (organic compound vapor spraying, and diffusion of carbon) is repetitively carried out in separate steps inside the heating furnace. The quenching means rapidly cools the carburized material taken out of the heating furnace, and causes a hardened structure to be produced in the material.

According to the embodiment, a large-scale conversion furnace or a dedicated carburizing furnace for producing carburizing gas becomes unnecessary, and the carburization treatment, which is carried out in a manufacturing process of a steel product such as a spring manufacturing process, can be performed safely and efficiently with less items of equipment.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A carburization device according to a first embodiment will be described with reference to FIGS. 1 to 4.

Figure 1:
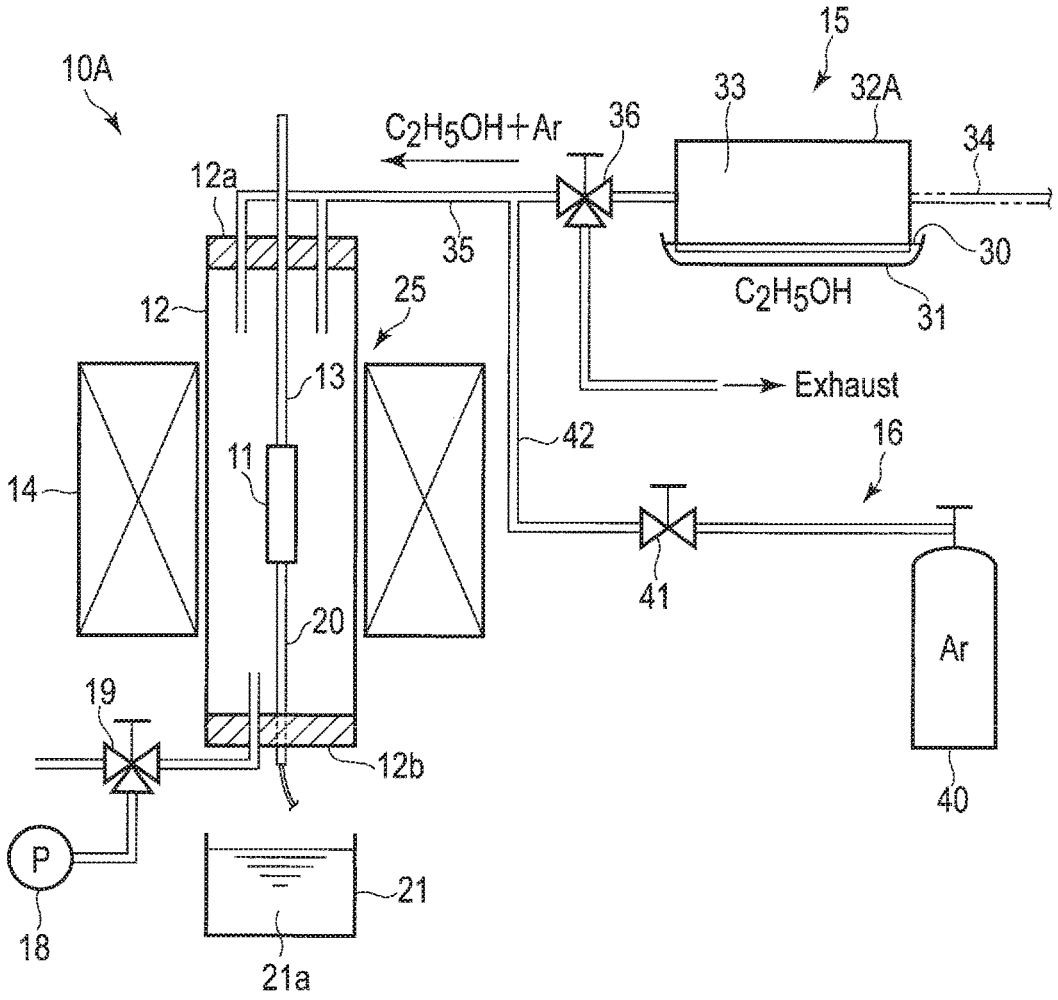
FIG. 1 is an illustration schematically showing the structure of a carburization device according to a first embodiment.

FIG. 1 schematically shows the structure of a carburization device 10A implemented at a site equivalent to a laboratory. The carburization device 10A includes a container 12 which accommodates a material 11 made of steel, a holder 13 which holds the material 11 within the container 12, an infrared-ray converging-type heater 14 which heats the material 11, an alcohol vapor supply system 15 which is an example of an organic compound supply system, an inert gas supply system 16, an exhaust pump 18, a switching valve 19, a temperature sensor (a thermocouple) 20 which detects a temperature of the material 11, a cooling tank 21 which is to be used in quenching the material 11, etc. Cold water 21*a* is accommodated in the cooling tank 21.

The container 12 is constituted of a quartz tube, for example, and keeps the inside of the container 12 airtight by an upper lid 12*a* and a bottom lid 12*b* which is openable and closable. The material 11 as a test piece is, for example, a steel rod (an oil hardened and tempered wire) having a diameter of 12 mm, and a length of 50 mm. The chemical components (wt %) of the oil hardened and tempered wire are C:0.41, Si:2.2, Mn:0.84, Cr:0.11, Ni:0.16, Cu:0.26, and Fe: the remainder. A heating furnace 25 is constituted of the container 12 and the heater 14.

The alcohol vapor supply system 15 includes a tray 31 as a container portion, an alcohol vapor generator 32A for producing alcohol vapor, and a switching valve 36, etc. The tray 31 accommodates an alcohol solution 30, which is an example of a liquid organic compound. An example of the alcohol is ethyl alcohol ($C_2H_5OH$). A liquid used in a carburization treatment is not limited to alcohol, and it suffices that the liquid to be used is an organic compound having a molecular structure including at least oxygen. For example, ketone such as acetone and various acids may be used.

An example of the alcohol vapor generator 32A includes a porous block (for example, a firebrick) 33, which is an example of a porous body having an open-celled foam structure, and an electric heater arranged within a flow hole of the porous block 33. At least a part of the porous block 33 is immersed in the alcohol solution 30 accommodated in the tray 31. The alcohol solution is penetrated and diffused in the porous block 33, and alcohol vapor obtained as a result of vaporization in the porous block 33 is fed into a mixing pipeline 35.

In another example of the alcohol vapor generator, instead of using the electric heater as a heat source, heat intake means for taking heat of the heating furnace 25 into the porous block 33 is adopted. An example of the heat intake means is a pipe 34 for taking in the heat of the heating furnace 25. By connecting the pipe 34 to the porous block 33, the porous block 33 is heated by utilizing the heat of the heating furnace 25.

Alcohol vapor is produced by the alcohol vapor generator 32A. As the alcohol vapor is supplied to the container 12 through the mixing pipeline 35, the interior of the container 12 is filled with the alcohol vapor. As the high-temperature material 11 is brought into contact with the alcohol vapor inside the container 12, carbon in the alcohol adsorbs to the material 11.

The inert gas supply system 16 includes a gas supply source 40 and an opening and closing valve 41. Inert gas such as argon is accommodated in the gas supply source 40. When the opening and closing valve 41 is opened, argon gas in the gas supply source 40 is supplied to the mixing pipeline 35 through the opening and closing valve 41 and a pipeline 42. The alcohol vapor can be diluted by the inert gas such as argon gas.

The material 11 in the container 12 is heated to approximately 1000° C. by the heater 14. In a state in which the temperature is maintained, alcohol vapor is produced by the alcohol vapor generator 32A. The alcohol vapor is supplied to the container 12 through the mixing pipeline 35. As the container 12 is filled with the alcohol vapor for a certain period of time (for example, 7 seconds), carbon in the alcohol adsorbs to the material. After that, by switching the switching valve 36, supply of the alcohol vapor from the alcohol vapor generator 32A is stopped.

The alcohol vapor inside the container 12 is discharged by the exhaust pump 18, and the container 12 is filled with argon gas supplied from the gas supply source 40. In a state in which the interior of the container 12 is set to an atmosphere of argon gas, an interval of a certain period of time (for example, 53 seconds) is taken. By doing so, carbon is diffused in the material 11, and soot is also prevented from adhering to a surface of the material 11.

In this way, a carburization treatment for the first time (i.e., alcohol vapor spraying and diffusion of carbon for the first time) is carried out. After that, the carburization treatment for the second time onward (alcohol vapor spraying and diffusion of carbon for the second time onward) is carried out. In the carburization treatment for the second time onward, the above-described carburization treatment (alcohol vapor spraying and diffusion of carbon) is repeated a plurality of times. Consequently, a carburized layer having a carbon concentration of 0.4 to 1.2% by weight is formed at a depth of 1 mm or so from the surface of the material 11.

When the carburization treatment is finished, the bottom lid 12*b* of the container 12 is opened. The material 11 which is at a high temperature (i.e., a temperature at which quenching can be performed) taken out of the container 12 is put into the cold water 21*a* of the cooling tank 21 and is cooled rapidly, thereby performing the quenching. By this quenching treatment, a hardened structure (martensite) is formed in at least a surface layer portion of the material 11.

Figure 2:
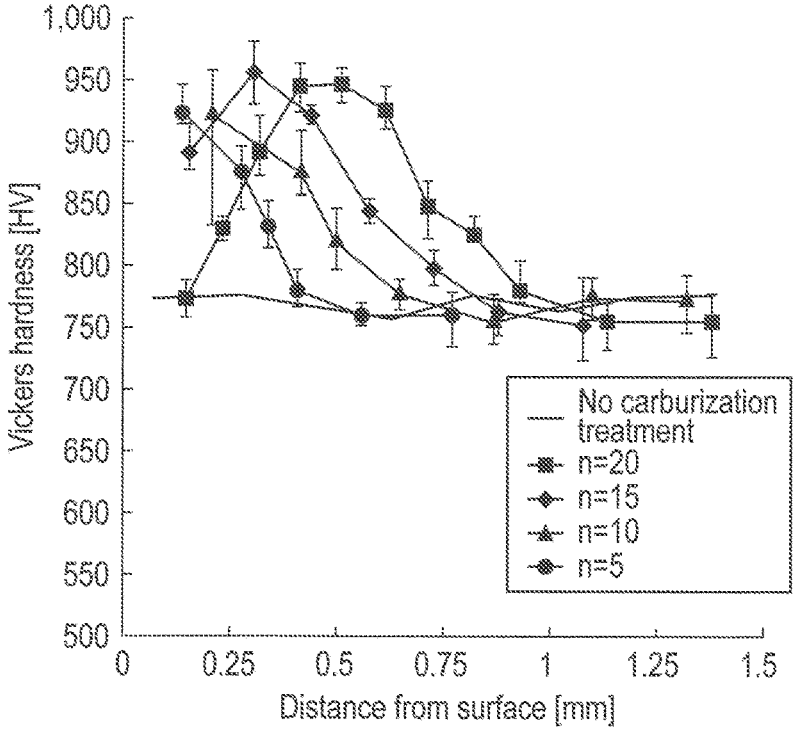
FIG. 2 is a graph showing the relationship between a distance from a surface and Vickers hardness for each of the cases where the number of repetitions of carburization treatment is 5, 10, 15, and 20.
Figure 3:
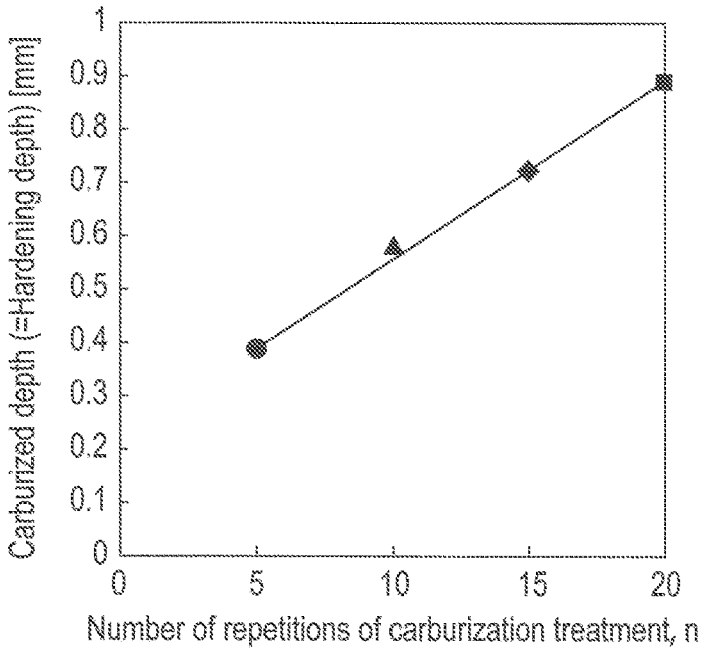
FIG. 3 is a graph showing the relationship between the number of repetitions of carburization treatment and a carburized depth.

FIG. 2 shows the relationship between a distance from a surface of the material and Vickers hardness for each of the cases where the number of repetitions (n) of the carburization treatment is 5, 10, 15, and 20. FIG. 3 shows the relationship between the number of repetitions (n) of the carburization treatment and the carburized depth. As can be understood from FIGS. 2 and 3, the more the carburization treatment is repeated, the deeper the hardening is achieved from the material surface, and the deeper the position is with respect to the peak of the hardness.

Figure 4:
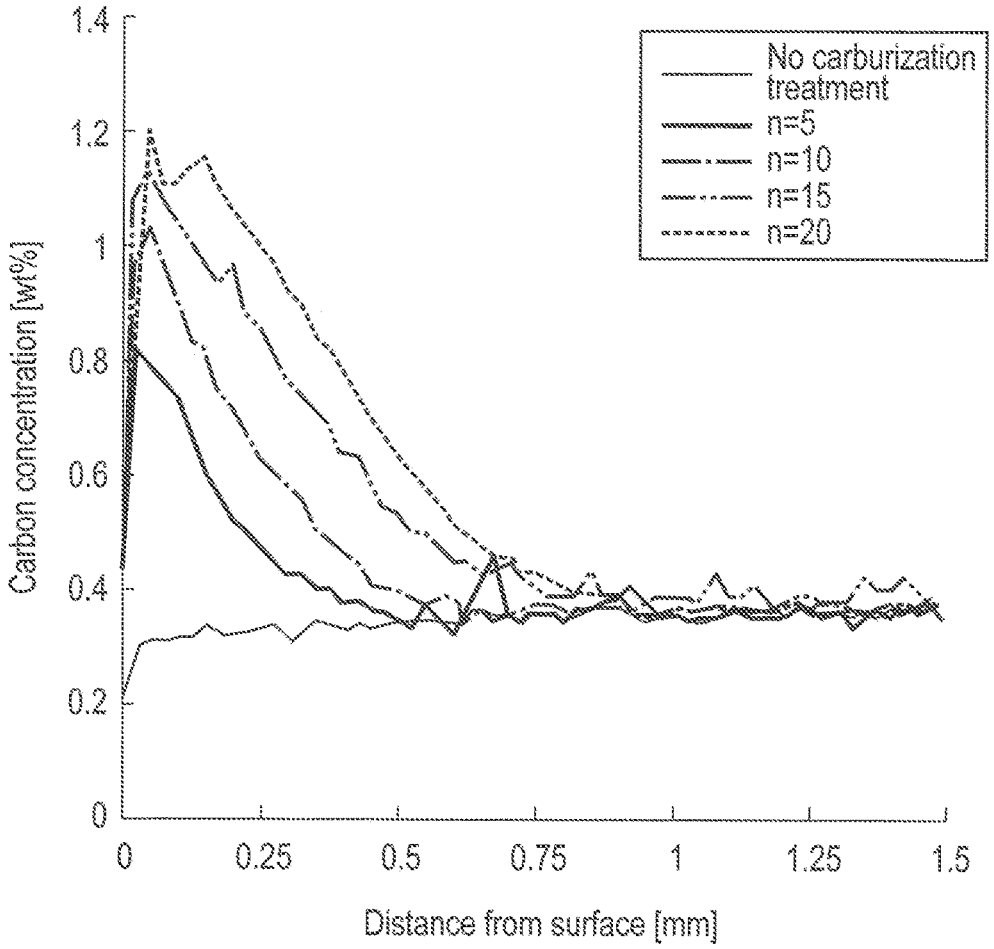
FIG. 4 is a graph showing the relationship between a distance from a surface and a carbon concentration for each of the cases where the number of repetitions of the carburization treatment is 5, 10, 15, and 20.

FIG. 4 shows the relationship between a distance from a surface of the material and the carbon concentration for each of the cases where the number of repetitions (n) of the carburization treatment is 5, 10, 15, and 20. From FIG. 4, it can be understood that in the surface layer portion which is a portion at a point of approximately 1 mm from the surface, the greater the number of carburization treatments is, the more the carbon concentration is increased, and the deeper the place where the carbon concentration can be increased is.

A carburization device according to a second embodiment will be described with reference to FIGS. 5 and 6.

Figure 5:
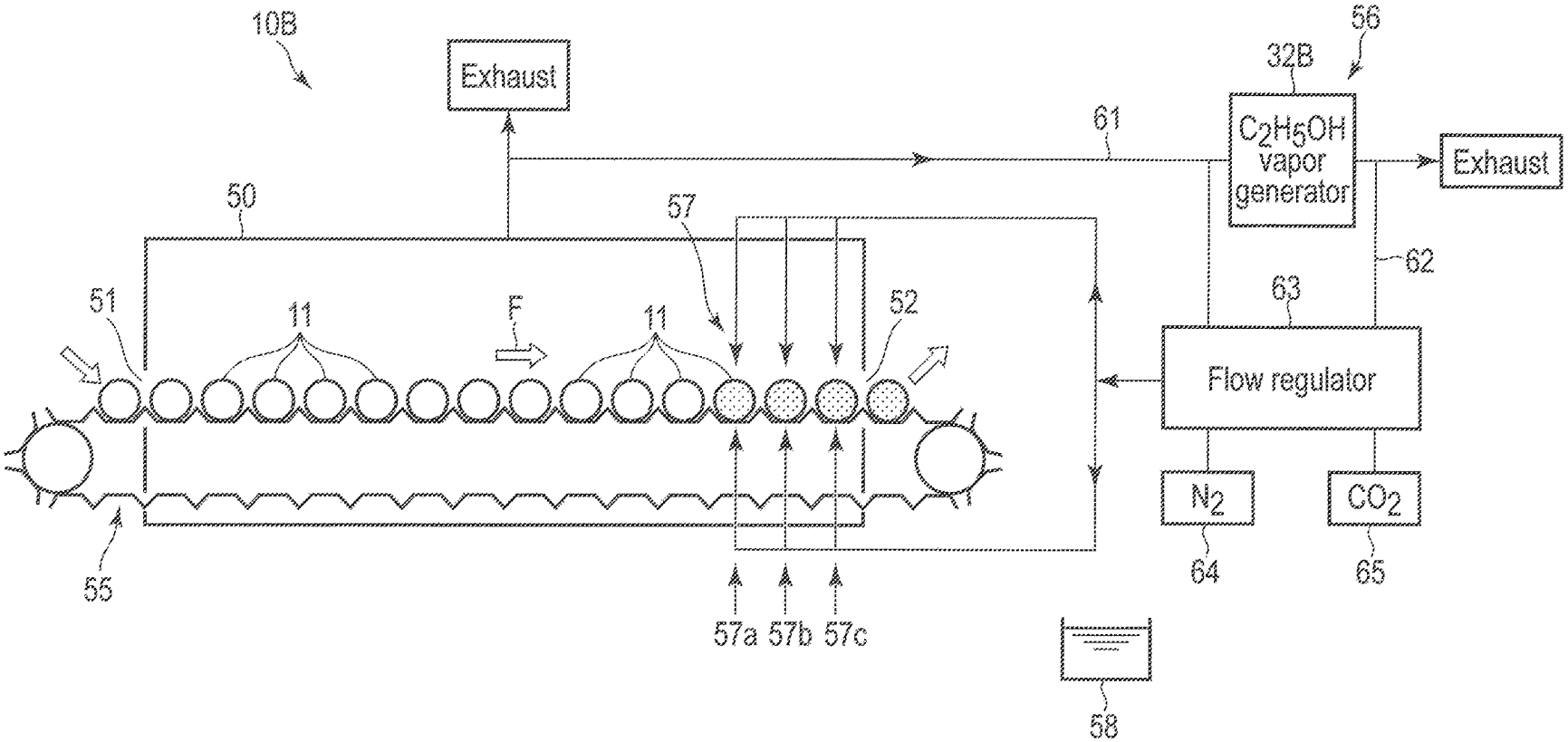
FIG. 5 is an illustration schematically showing the structure of a carburization device according to a second embodiment.

FIG. 5 schematically shows a carburization device 10B which performs carburization at a site equivalent to a factory in a spring manufacturing process. The carburization device 10B comprises a heating furnace 50, a transfer mechanism 55, an alcohol vapor supply system 56, an alcohol vapor spraying portion 57, a quenching tank 58 as the quenching means, etc. The heating furnace 50 functions as a heat treatment furnace which heats a material 11 made of spring steel. The transfer mechanism 55 moves a plurality of materials 11 from an inlet portion 51 of the heating furnace 50 toward an outlet portion 52 of the same. A quenching liquid such as water or oil is accommodated in the quenching tank 58.

The heating furnace 50 forms a flame by burning inflammable gas such as city gas. By this flame, the material 11 is heated to a temperature (for example, 980° C.) at which the quenching can be performed. In a manufacturing process of a steel product such as a spring member, the heating furnace 50 heats the material 11 made of steel to an austenitizing temperature. More specifically, the heating furnace 50 is a temperature-raising furnace (a heat treatment furnace), and heats the material 11 under atmospheric conditions of an open system. The type of heating of the heating furnace 50 is not limited to an open-type gas heating furnace. For example, a heating furnace of indirect heating comprising a radiant tube may be employed. Alternatively, the inside of the furnace may be heated by using a radiant heat generated by a radiant tube burner using a radiant tube.

An example of the transfer mechanism 55 is an intermittent movement type device which makes a progress and a pause alternately such as a walking beam. The plurality of materials 11 are moved from the inlet portion 51 of the heating furnace 50 toward the outlet portion 52 of the same by the transfer mechanism 55 in a direction indicated by arrow F in FIG. 5. As another embodiment of the transfer mechanism 55, a conveyor which is moved endlessly continuously may be adopted.

Figure 6:
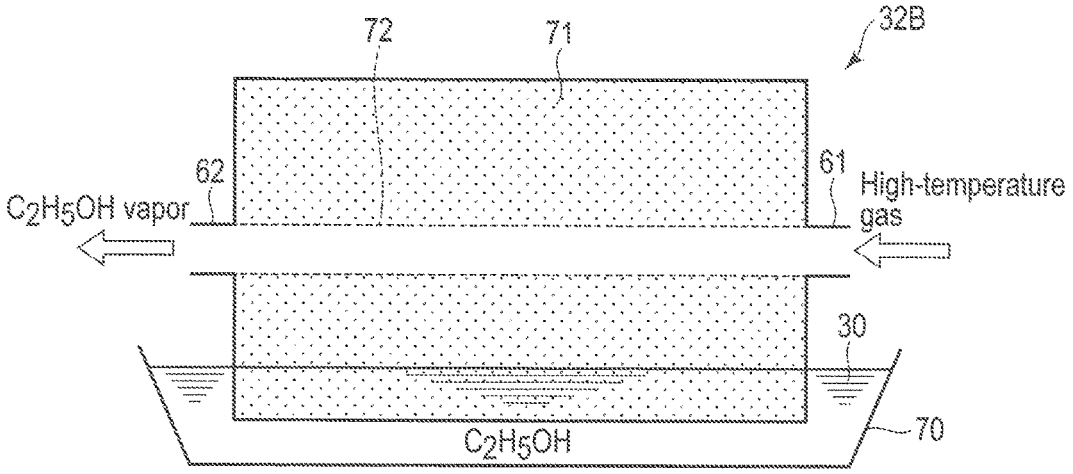
FIG. 6 is a cross-sectional view schematically showing an example of an organic compound vapor generator of the carburization device shown in FIG. 5.

The alcohol vapor supply system 56 comprises an alcohol vapor generator 32B, an exhaust heat intake tube 61, an alcohol vapor supply tube 62, a flow regulator 63, an inert gas supply portion. 64, and a carbon dioxide gas supply portion 65, which are schematically shown in FIG. 6. The exhaust heat intake tube 61 which functions as exhaust heat intake means uses part of the heat generated by the heating furnace 50 as a heat source of the alcohol vapor generator 32B.

The flow regulator 63 is arranged between the alcohol vapor generator 32B and the heating furnace 50. Alcohol vapor is supplied toward the alcohol vapor spraying portion 57 from the alcohol vapor generator 32B. An amount of the alcohol vapor is regulated by the flow regulator 63. If necessary, inert gas such as nitrogen is supplied from the inert gas supply portion 64. Alternatively, carbon dioxide may be supplied from the carbon dioxide gas supply portion 65.

An example of the alcohol vapor generator 32B shown in FIG. 6 comprises a tray 70, a porous block 71, and a flow hole 72 formed in the porous block 71. The tray 70 is an example of a container portion which accommodates an alcohol solution 30. The porous block 71 is an example of a porous body having an open-celled foam structure which is impregnated with the alcohol solution 30 in the tray 70. Part of high-temperature gas produced in the heating furnace 50 flows into the flow hole 72 through the exhaust heat intake tube 61. The heat of the high-temperature gas vaporizes alcohol (ethyl alcohol) in the porous block 71. Alcohol gas obtained by the vaporization is supplied to the alcohol vapor spraying portion 57 from the alcohol vapor supply tube 62. The exhaust heat intake tube 61 in this case functions as the heating means for heating at least a part of an inner surface of the flow hole 72.

The alcohol vapor spraying portion 57 includes a plurality of nozzles 57*a*, 57*b*, and 57*n*. These nozzles 57*a*, 57*b*, and 57*n* spray the alcohol vapor on the materials 11 which move inside the heating furnace 50 stepwise. Accordingly, the nozzles 57*a*, 57*b*, and 57*n* surround the materials 11, which are moved inside the heating furnace 50 by the transfer mechanism 55, near the outlet portion 52. Moreover, these nozzles 57*a*, 57*b*, and 57*n* are arranged at intervals in a direction of movement of the materials 11, in other words, are arranged at separate stages.

The nozzle 57*a* at a first stage is arranged on an upstream side in the direction of movement of the materials 11 near the outlet portion 52 of the heating furnace 50. The nozzle 57*b* at a second stage is arranged on a more downstream side in the direction of movement of the materials 11 as compared to the nozzle 57*a* at the first stage. The nozzle 57*n* at an N-th stage (a third stage onward) is arranged on a more downstream side in the direction of movement of the materials 11 as compared to the nozzle 57*b* at the second stage.

The alcohol vapor produced by the alcohol vapor generator 32B is ejected toward the materials 11 from the respective nozzles 57*a*, 57*b*, and 57*n*. Accordingly, highly-concentrated alcohol vapor exists around the materials 11. An interval section (i.e., a section for diffusion of carbon) in which a concentration of the alcohol vapor is substantially extremely low is formed between the adjacent nozzles of the nozzles 57*a*, 57*b*, and 57*n*.

Figure 7:
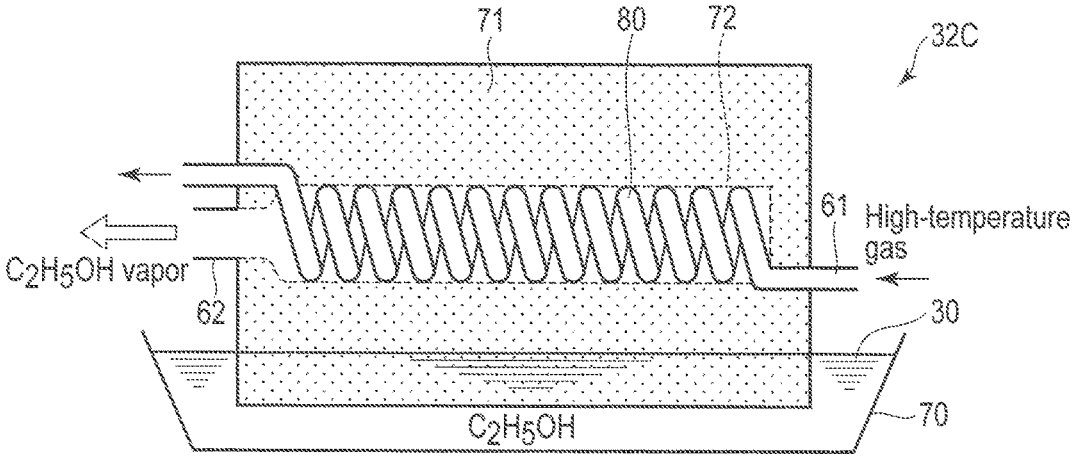
FIG. 7 is a cross-sectional view schematically showing another example of the organic compound vapor generator.

FIG. 7 is a cross-sectional view which schematically shows another example of the alcohol vapor generator. An alcohol vapor generator 32C shown in FIG. 7 includes a high-temperature gas passage 80 within the flow hole 72 formed in the porous block 71. The exhaust heat intake tube 61 is connected to the high-temperature gas passage 80. Part of high-temperature gas in the heating furnace 50 flows in the high-temperature gas passage 80. The high-temperature gas passage 80 functions as heating means for heating at least a part of an inner surface of the flow hole 72. By the heat of the high-temperature gas of the heating furnace 50 which flows through the high-temperature gas passage 80, alcohol solution in the porous block 71 is evaporated. Alcohol vapor obtained by evaporation is supplied to the alcohol vapor spraying portion 57 (FIG. 5) through the flow hole 72, the alcohol vapor supply tube 62, and the flow regulator 63.

In the case of the carburization device 10B which performs carburization at a site equivalent to a factory in a spring manufacturing process, the alcohol vapor generator may use an external heat source without using the heat of the heating furnace. For example, an electric heater can be used as a heat source such as in an alcohol vapor generation system according to the first embodiment.

Figure 8:
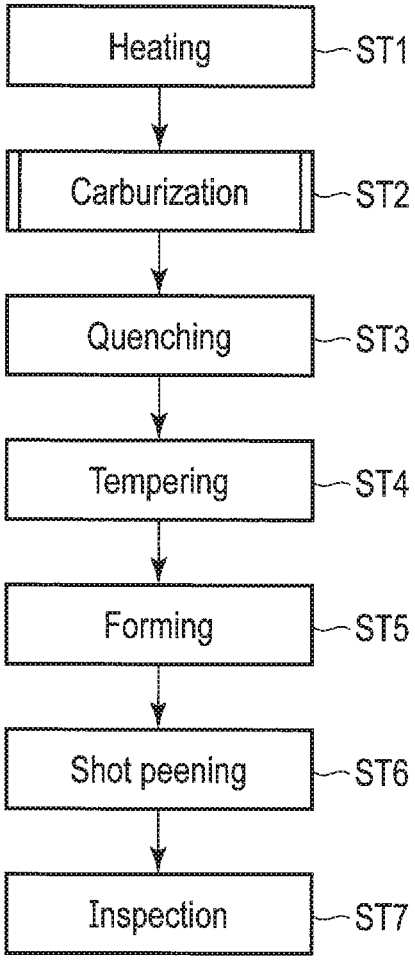
FIG. 8 is a diagram showing an example of a method of manufacturing a steel product which uses the carburization device shown in FIG. 5 in the order of steps.
Figure 9:
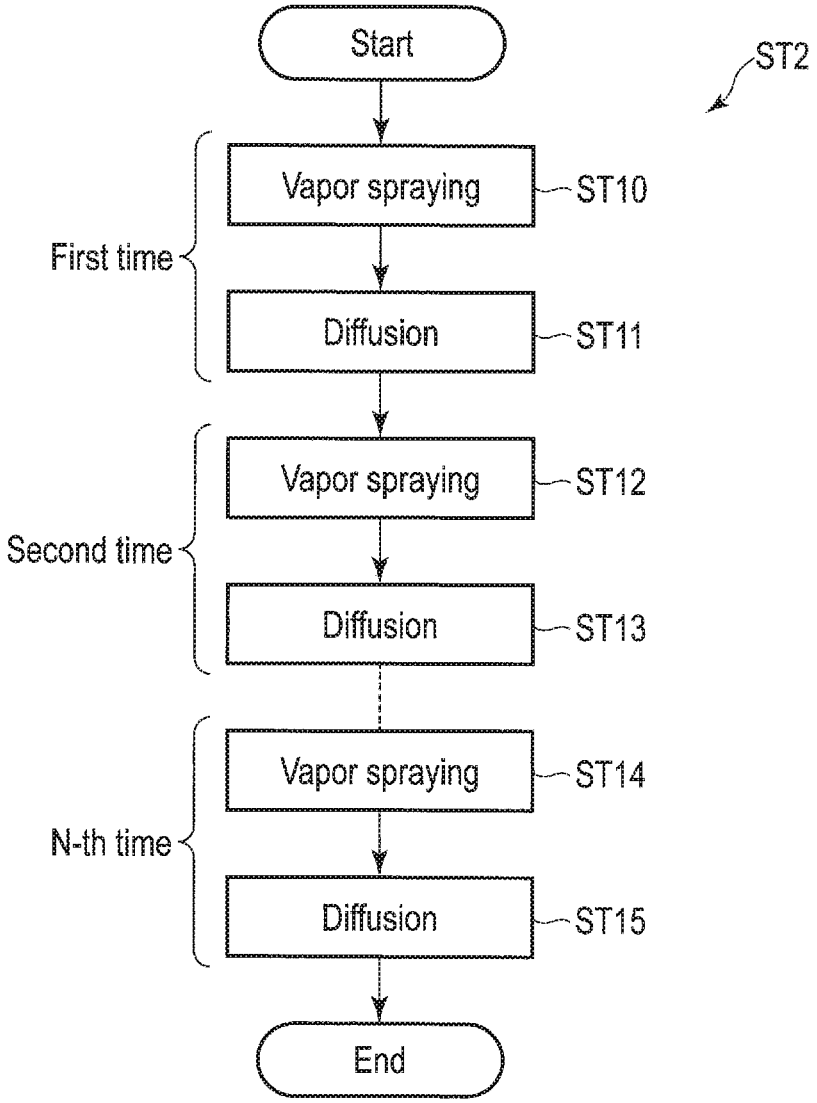
FIG. 9 is a diagram showing details of a carburization step, which is a part of the manufacturing method shown in FIG. 8.

FIG. 8 shows an example of a manufacturing process of manufacturing a steel product such as a spring member. In step ST1 (heating step) of FIG. 8, the material 11 made of steel such as spring steel is heated in the heating furnace 50. In step ST2 (carburization step), a carburization treatment is performed by using the carburization device 10B. FIG. 9 shows the details of step ST2 (carburization step) of FIG. 8.

As shown in FIG. 9, in the carburization step (step ST2), the material 11 which moves within the heating furnace 50 is moved to a position opposed to the nozzle 57*a* (FIG. 5) at the first stage. In a state in which the material 11 is opposed to the nozzle 57*a* at the first stage, the nozzle 57*a* at the first stage sprays the alcohol vapor on the material 11. In this way, vapor spraying step ST10, which is the first vapor spraying step, is carried out, and carbon in the alcohol adsorbs to the material 11. With respect to the carbon adsorbed to the material 11, by way of diffusion step ST11, which is the first diffusion step, the carburizing action progresses by the Boudouard reaction ($2CO \rightarrow [C]+CO_2$), etc.

After the first diffusion step ST11, the material 11 is moved to a position opposed to the nozzle 5 in (FIG. 5) at the second stage. When the material 11 is opposed to the nozzle 57*b* at the second stage, the alcohol vapor is sprayed on the material 11 again by the nozzle 57*b* at the second stage. In this way, vapor spraying step ST12, which is the second vapor spraying step, is carried out, and carbon in the alcohol adsorbs to the material 11. With respect to the carbon adsorbed to the material 11, by way of diffusion step ST13, which is the second diffusion step, the carburizing action progresses again by the Boudouard reaction etc., and the carbon concentration near the surface of the material 11 is increased.

After the second diffusion step ST13, the material 11 is moved to a position opposed to the nozzle 57*n* (FIG. 5) at the N-th stage. When the material 11 is opposed to the nozzle 57*n* at the N-th stage, the alcohol vapor is sprayed on the material 11 again by the nozzle 57*n* at the N-th stage. In this way, vapor spraying step ST14, which is the N-th vapor spraying step, is carried out, and carbon in the alcohol adsorbs to the material 11. With respect to the carbon adsorbed to the material 11, by way of diffusion step ST15, which is the N-th diffusion step, the carburizing action progresses again by the Boudouard reaction etc., and the carbon concentration near the surface of the material 11 is further increased. As described above, the carburization treatment (alcohol vapor spraying and diffusion) is repeated a plurality of times (N times) within the heating furnace 50.

Carburization is performed by the carburization step (step ST2), and the material 11 kept at a high temperature is carried outside the heating furnace 50 from the outlet portion 52 of the heating furnace 50. In step ST3 of FIG. 8, the material 11 is thrown into the quenching tank 58. As the material 11 thrown into the quenching tank 58 is rapidly cooled with a temperature gradient of forming a hardened structure (martensite), a hardened structure is formed in at least a surface layer portion of the material 11.

After that, in step ST4 of FIG. 8, a tempering heat treatment is performed. Since the material 11 has gone through the carburization step, the material 11 has sufficient hardness after the tempering. Further, in step ST5 (forming step), the material 11 is formed into a predetermined shape (for example, the shape of a coil spring) by plastic working, etc. In step ST6, shot peening is performed, and compressive residual stress is applied to the surface of the material 11. An aftertreatment such as setting and coating is performed as necessary. In step ST7, product inspection is performed and the spring member is completed.

Figure 10:
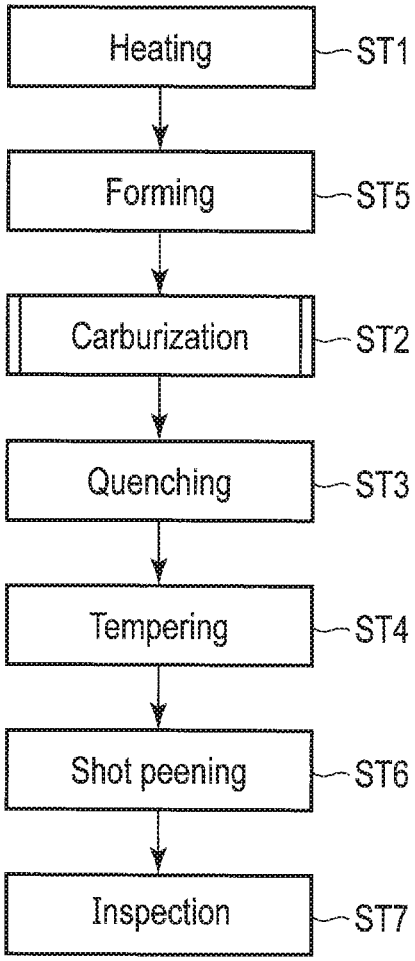
FIG. 10 is a diagram showing an example of a manufacturing method when a steel product is to be manufactured by hot working in the order of steps.

FIG. 10 shows an example of a manufacturing process in forming the steel product by hot working (at a recrystallization temperature or higher). In step ST1 (heating step) of FIG. 10, the material 11 is heated to an austenitizing temperature. In a state in which this temperature is maintained, in step ST5 (forming step) of FIG. 10, the material 11 is formed by hot working.

When hot forming is performed, decarburization occurs on the surface of the material 11 to some extent. Hence, in the present embodiment, a carburization step corresponding to step ST2 is carried out after the hot forming. More specifically, in step ST2, the carburization treatment is performed in the heating furnace 50 by the carburization device 10B (FIG. 5). Also an this case, alcohol vapor spraying and carbon diffusion are repeated a plurality of times (N times), as shown in FIG. 9, thereby performing the carburization treatment stepwise. After step ST2 (carburization step) has been finished, heat treatments such as quenching and tempering (steps ST3 and ST4) are performed if necessary. Further, shot peening, inspection (steps ST6, ST7), and the like, are carried out.

In the explanation of the manufacturing process related to FIG. 10, step ST2 (carburization step) is carried out after step ST5 (forming step). However, step ST2 (carburization step) may be carried out simultaneously with step ST1 (heating step), or after step ST1 (heating step).

As described above, a carburization method for the steel product according to the present embodiment includes the following steps:

(1) Heating a material made of steel to a temperature at which quenching can be performed in a heating furnace;

(2) Generating alcohol vapor by evaporating an alcohol solution;

(3) Moving the material from an inlet portion toward an outlet portion of the heating furnace continuously or intermittently;

(4) Repeating a vapor spraying step of spraying the alcohol vapor on the material in the heating furnace and a diffusion step for diffusion of carbon a plurality of times in the heating furnace; and (5) Rapidly cooling the material which has been taken out of the heating furnace, thereby producing a hardened structure.

According to the carburization device 10B and the carburization method of the present embodiment, a conversion furnace for producing carburizing gas or a dedicated carburizing furnace is unnecessary. Accordingly, the carburization treatment can be performed with less items of equipment, and the treatment is safe since ethanol vapor is used as the carburization gas. Also, the carburization treatment can performed substantially simultaneously with the heat treatment in a heat treatment furnace (heating furnace) which constitutes a part of a manufacturing line that continuously produces a workpiece (a steel product). Accordingly, a steel product having a carburized layer can be produced efficiently.

It is to be understood, in carrying out the present invention, that the form such as the specific structure and arrangement of elements which constitute the carburization device according to the present invention, i.e., elements including the heating furnace, the transfer mechanism, the alcohol vapor generator, the exhaust heat intake means, the alcohol vapor spraying portion, and the quenching means may be embodied in various forms if necessary. The alcohol used in carburization is not limited to ethyl alcohol, and may be any as long as it is a compound having a structure in which a hydrogen atom of a carbon hydride is substituted with a hydroxyl group and it is a substance that can vaporize, in short.

Figure 11:
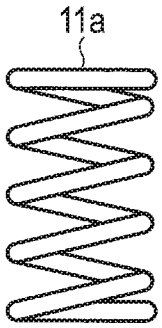
FIG. 11 is a front view showing a first example of the steel product.
Figure 12:
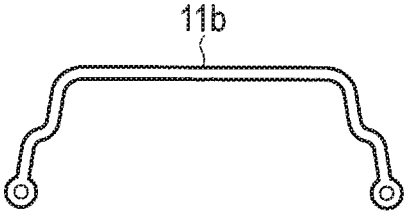
FIG. 12 is a front view showing a second example of the steel product.
Figure 13:
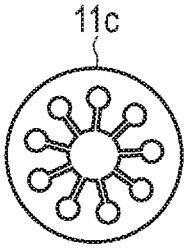
FIG. 13 is a front view showing a third example of the steel product.
Figure 14:
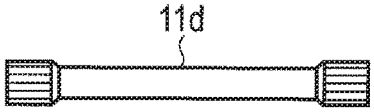
FIG. 14 is a front view showing a fourth example of the steel product.
Figure 15:
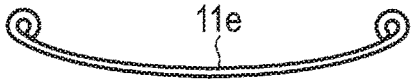
FIG. 15 is a front view showing a fifth example of the steel product.

The carburization device and the carburization method of the embodiments described above can be applied to various forms of machine element components made of steel including a spring member made of spring steel. FIGS. 11 to 17 schematically illustrate first to seventh examples of the spring member, which is a steel product. FIG. 11 shows a helical spring 11*a* such as a coil spring. FIG. 12 shows a vehicle stabilizer 11*b*. FIG. 13 shows a disc spring 11*c*, FIG. 14 shows a torsion bar 11*d*, and FIG. 15 shows a leaf spring 11*e*.

Figure 16:
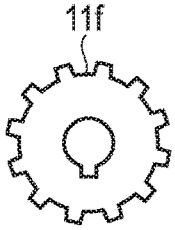
FIG. 16 is a front view showing a sixth example of the steel product.
Figure 17:
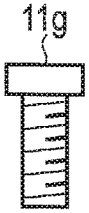
FIG. 17 is a front view showing a seventh example of the steel product.

The carburization device and the carburization method of the present invention may be applied to a machine element such as a gear wheel 11*f* shown in FIG. 16 or a screw member 11*g* shown in FIG. 17, for example, apart from the above spring members. The carburization device and the carburization method of the present invention may be applied to industrial products other than the above. In other words, the present invention can be applied to any steel product in which a carburized layer having a high carbon concentration is desired to be formed on a surface layer portion by the carburization.

Additional advantages and modifications wall readily occur to those skilled in the art. Therefore, the invention in its broader aspects is not limited cc the specific details and representative embodiments shown and described herein. Accordingly, various modifications may be made without departing from the spirit or scope of the general inventive concept as defined by the appended claims and their equivalents.

What is claimed is:

1. A carburization device comprising:

a heating furnace which heats a material made of steel;

a transfer mechanism which continuously or intermittently moves a plurality of materials each corresponding to the material from an inlet portion toward an outlet portion of the heating furnace;

an alcohol vapor generator which generates alcohol vapor by evaporating a liquid alcohol;

an alcohol vapor spraying portion which sprays the alcohol vapor on the material moving within the heating furnace, thereby causing carbon in the alcohol to be adsorbed to the material, and sprays the alcohol vapor on the material again after an interval of time for diffusing the carbon adsorbed to the material in the material;

quenching means for rapidly cooling the material taken out of the heating furnace and producing a hardened structure in the material; and exhaust heat intake means for using part of heat generated by the heating furnace as a heat source of the alcohol vapor generator.

2. The carburization device of claim 1, wherein the alcohol vapor generator comprises a container portion which accommodates the liquid alcohol, and a porous body into which the liquid alcohol in the container portion is penetrated and diffused, and the alcohol vapor is produced by heating an inside of a flow hole of the porous body.

3. The carburization device of claim 2, wherein the alcohol vapor generator comprises heating means for heating at least a part of an inner surface of the flow hole.

4. The carburization device of claim 1, wherein the heating furnace is a heat treatment furnace which heats the material to an austenitizing temperature.

5. The carburization device of claim 1, wherein the alcohol vapor spraying portion comprises a plurality of nozzles which are arranged at separate stages in a moving direction of the transfer mechanism.

6. The carburization device of claim 1, wherein the alcohol is ethyl alcohol.

7. A carburization device comprising:

a heating furnace which heats a material made of steel;

a transfer mechanism which continuously or intermittently moves a plurality of materials each corresponding to the material from an inlet portion toward an outlet portion of the heating furnace;

an alcohol vapor generator which generates alcohol vapor by evaporating a liquid alcohol;

an alcohol vapor spraying portion which sprays the alcohol vapor on the material moving within the heating furnace, thereby causing carbon in the alcohol to be adsorbed to the material, and sprays the alcohol vapor on the material again after an interval of time for diffusing the carbon adsorbed to the material in the material; and quenching means for rapidly cooling the material taken out of the heating furnace and producing a hardened structure in the material, wherein the alcohol vapor generator comprises a container portion which accommodates the liquid alcohol, and a porous body into which the liquid alcohol in the container portion is penetrated and diffused, and the alcohol vapor is produced by heating an inside of a flow hole of the porous body.

8. The carburization device of claim 7, wherein the alcohol vapor generator comprises heating means for heating at least a part of an inner surface of the flow hole.

9. The carburization device of claim 7, wherein the heating furnace is a heat treatment furnace which heats the material to an austenitizing temperature.

10. The carburization device of claim 7, wherein the alcohol vapor spraying portion comprises a plurality of nozzles which are arranged at separate stages in a moving direction of the transfer mechanism.

11. The carburization device of claim 7, wherein the alcohol is ethyl alcohol.

* * * * *